US005084706A

United States Patent [19]

Ross et al.

[11] Patent Number: 5,084,706

[45] Date of Patent: Jan. 28, 1992

[54] SYNCHRONIZATION OF VERY SHORT PULSE MICROWAVE SIGNALS FOR ARRAY APPLICATIONS

[76] Inventors: Gerald F. Ross, 775 Longboat Club Rd. #605, Longboat Key, Fla. 34228; Richard M. Mara, 51 Hill St., Tewksbury, Mass. 01876

[21] Appl. No.: 451,430

[22] Filed: Dec. 15, 1989

[51] Int. Cl.[5] ..... H01Q 3/26

[52] U.S. Cl. ..... 342/368; 342/202

[58] Field of Search ..... 342/21, 202, 203, 204, 342/368

[56] References Cited

U.S. PATENT DOCUMENTS

| | | | |
|---|---|---|---|
| 3,524,186 | 8/1970 | Fleri et al. | 342/368 |
| 3,714,655 | 1/1973 | Ross et al. | 342/368 |
| 3,940,696 | 2/1976 | Nagy | 342/204 |
| 4,743,906 | 5/1988 | Fullerton | 342/21 X |

*Primary Examiner*—Gilberto Barrón, Jr.

[57] ABSTRACT

A transmitter array includes a number of individual transmitters, each contributing a series of short microwave pulses each consisting of only several cycles to make up an RF pulse in the far field. Apparatus for closed loop synchronizing the pulses from each transmitter in order to maximize the amplitude of the RF pulse includes a Voltage Control Oscillator which provides a continuous wave (CW) reference to each transmitter and includes apparatus for dividing the CW down to feed a series of timers in each transmitter, each timer having a means for setting the time and duration of firing and providing an output signal synchronously related to the CW. A dual polarity peak detector fine tunes the individual transmitters via closed loop feedback to compensate for any thermal drift. A novel time delay vs. voltage transducer is used to achieve closed loop synchronization. Short term pulse jitter is significantly reduced by overtriggering the avalanche transistor. Beam steering is accomplished by simply adjusting a regulated DC voltage at each radiating source in the array. The end result is a low cost means for forming a time steered array of short pulse microwave sources.

20 Claims, 4 Drawing Sheets

SYNCHRONIZATION OF VERY SHORT PULSE MICROWAVE SIGNALS FOR ARRAY APPLICATIONS

BACKGROUND OF THE INVENTION

1. Field of the Invention

The invention pertains primarily to the field of transmission of short pulse microwave signals, and more specifically the synchronization of these short pulse radiated signals from an array of solid state or other triggerable transmitters.

2. Description of the Prior Art

Combining or processing networks for efficiently combining coherent electromagnetic energy and focusing in the far field are essential for transmitting signals of very short pulse duration. They are of interest when these signals must be synchronized to yield a maximum signal incident on a selected target area or target in space. Generally, combining networks of the past have not had the capabilities of efficient operation over the subnanosecond duration required.

U.S. Pat. No. 3,714,655 entitled "Array Antenna Processing System" pertains to microwave transmission line coupling networks or matrices to receive signals from an antenna array. An output pulse is generated which represents "a substantially perfect summation of the total energy of the plurality of effectively discrete sources." This scheme is applicable to both receiving and transmitting applications. However the short term jitter and long term (thermal) drift present in solid state activated short pulse sources reduces the desired summation amplitude and degrades beam forming.

Another approach is the use of microcircuit switches on a gallium arsenide substrate. A high energy laser beam is radiated over the surface of the substrate causing each of the switches to break down simultaneously thereby synchronizing the pulse array, at least, at boresight. There are a number of problems with this approach. It is not energy efficient. Generally, more energy is required to break down the switches than is transmitted to a target. This results in a very costly laser and associated power supply system. Also the introduction of incremental time delays at each element necessary for steering the beam in space is required, resulting in additional hardware complexity and cost.

Other approaches use avalanche devices for beam formation and increased peak power in the far field. But these devices running without short term jitter or thermal compensation cannot control with the accuracy required; that is, to a small fraction of a microwave cycle (e.g., a number of picoseconds).

Accordingly, it is an object of the invention to provide an improved array microwave transmission system which meets the minimum absolute short term jitter and thermal drift requirements.

It is another object of the invention to provide an improved synchronization system for the array.

It is yet another object of the invention to provide an array having and an improved scanning capability.

It is still another object of the invention to provide an array having improved beam focusing capabilites.

SUMMARY OF THE INVENTION

The above objects and advantages are achieved in a preferred embodiment of the present invention. According to the preferred embodiment, a transmitter array includes a number of individual transmitters, each contributing a series of short pulses to make up an RF pulse in the far field. Only one or more RF cycles may be present in the resulting wave form.

The individual pulse sources in the array in the preferred embodiment consist of avalanche transistor—step recovery diode generators which, when appropriately triggered, produce a signal containing only several RF cycles in the far field. For the signals from all the pulse sources to coalesce at some angle in the far field, the short term (threshold sensitive) jitter and the long term thermal drift must be held to less than 10 picoseconds (ps); for example, for an L Band (1 to 2 GHz) transmission.

The subject invention accomplishes a reduction in the short term jitter to less than 2 ps by overtriggering the avalanche transistor source (e.g. a 5 volt trigger where 0.8 volts will produce a normal firing of the source).

Long term drift which typically can be as high as 200 ps per 100 milliseconds is held to an absolute value of 10 ps or less by a novel closed loop feedback technique which is described below. As part of this feedback scheme is the introduction of a new linear voltage vs. time delay transducer or "timer". This technique for closed loop synchronization also permits beam steering by the simple adjustment of an offset DC voltage within the feedback loop. This circumvents the need for variable length of line feeding each radiating element for beam steering.

Apparatus for synchronizing the pulses from each transmitter in order to maximize the amplitude of the RF pulse includes a Voltage Control Oscillator (VCO) which provides a continuous reference wave (CW) to each transmitter. Also included is apparatus for dividing the CW down to feed a series of timers in each transmitter, each timer having a means for setting the time delay and duration of firing and providing an output signal synchronously related to the CW.

Each transmitter further includes a "sniffer" mounted on a radiating structure which samples the pulse burst from its respective transmitter. The sampled pulse burst is fed to a mixer where it is combined with an output from the CW oscillator (VCO) to generate a positive or a negative pulse which depends on the phase difference between the frequencies of the CW and the transmitted pulse burst. The difference frequency between the VCO and the transmitted pulse burst is chosen to make the output pulse width equal to approximately one half of a cycle (i.e. a baseband pulse). The amplitude of the CW and the pulse burst signals are designed for efficient mixer operation.

Each timer is set to automatically shift the pulse burst to be locked with the CW VCO, thereby maximizing the amplitude of the pulse burst in the far field. The timer drive signal is fed to the base of an avalanche transistor which sets the phase of the pulse burst. The pulse burst from each transmitter is now in phase with the CW positive or negative reference thereby maximizing the RF pulse amplitude in the far field.

In each transmitter, the output pulse from the mixer is fed to a dual polarity peak detector which amplifies the positive or negative DC voltage so produced and feeds it to the base circuit of the avalanche transistor which serves as the timer and also generates the pulse burst. The peak detector detects any change in amplitude of the output pulse due to thermal drift, and compensates by slightly shifting the phase of the pulse burst relative to the CW completing the closed loop. It was found that back biasing the base-to-emitter junction of the avalanche transistor linearly delays the pulse burst.

A single Digital to Analog Converter provides a sequence of stepped voltage signals to each peak detector network thereby enabling the transmitter array to scan the target area.

BRIEF DESCRIPTION OF THE DRAWINGS

The novel features which are believed to be characteristic of the invention both as to its organization and method of operation, together with further objects and advantages will be better understood from the following description when considered in connection with the accompanying drawings. It is expressly understood, however, that each of the drawings is given for the purpose of illustration and description only and is not intended as a definition of the limits of the present invention.

DESCRIPTION OF THE PREFERRED EMBODIMENT

Figure 1A:
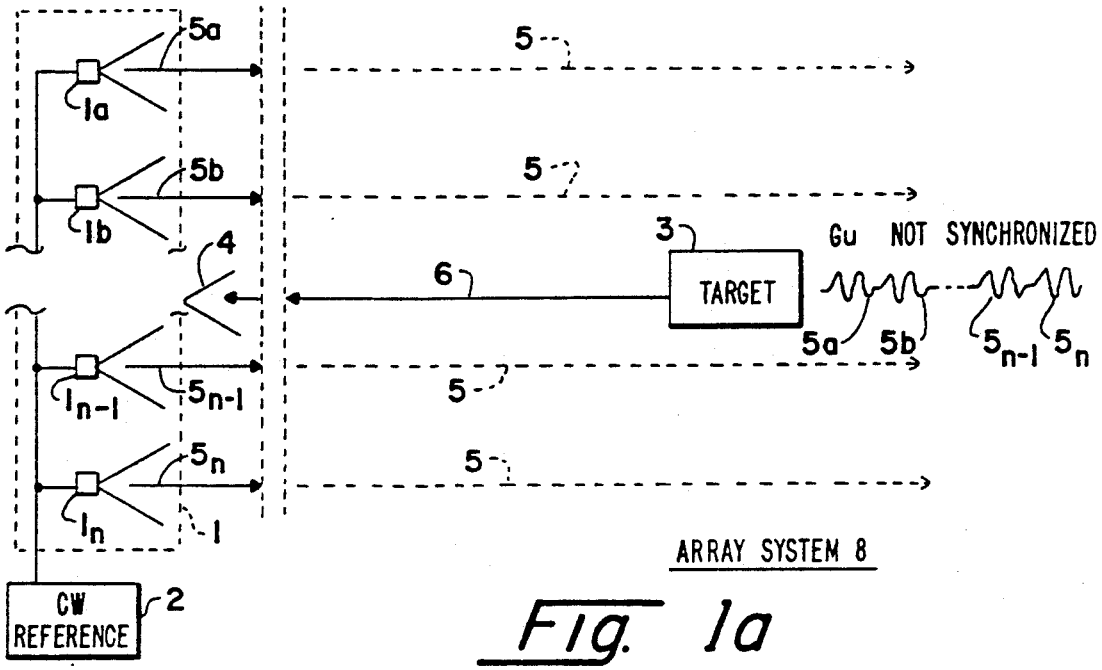
FIG. 1*a* shows an application of the transmitter array locating a target at approximately boresight to the array with unsynchronized transmitters.
Figure 1B:
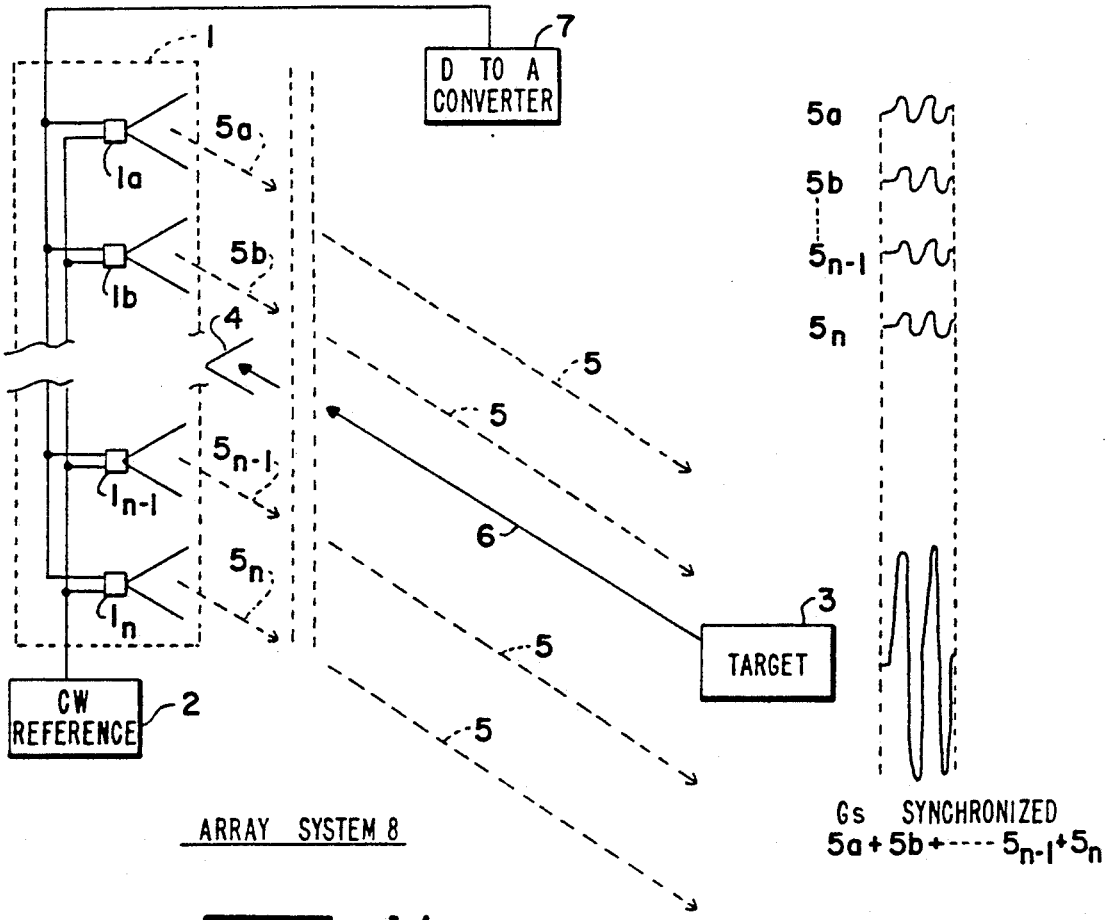
FIG. 1*b* shows the transmitter array locating the target at a predetermined angle to the array with the transmitters synchronized to each other.

FIGS. 1*a* and 1*b* show an array system 8 which include a transmitter array 1 and a CW reference source 2. Transmitter array 1 includes transmitter assemblies 1*a*, 1*b* through 1*n*-1 and 1*n* where "a through n" represent consecutive integers and "n" may represent in the order of 10 to 100 transmitters as a practical value. CW reference 2 provides continuous wave reference signals which are applied simultaneously to each assembly 1*a* through 1*n* to enable them to generate and synchronize their output pulses 5*a*, 5*b* through 5*n*-1 and 5*n* to each other. The broad band output pulses 5*a* through 5*n* are reflected by target 3 to receiver 4 as reflected pulses 6.

In FIG. 1*a*, the transmitters 1*a* through 1*n* are not in synchronization "Gu" with each other. Therefore output pulses 5*a* through 5*n* do not reinforce each other. This makes output pulse 5 a wide beam and dispersive system and reflected pulse 6 is a very weak signal having a very small amplitude.

FIG. 1*b* shows the stationary transmitter array 1 with the synchronized transmitters 1*a* through 1*n* generating the narrow pulse width of output pulses 5 for tracking target 3. The synchronization of output pulses 5*a* through 5*n* is so precise as to make the amplitude of output pulse 5 substantially equal to the sum of the amplitudes of the individual output pulses 5*a* through 5*n*. The maximum energy "Gs" is therefore applied to the target 3 resulting in reflected pulse 6 having a relatively large amplitude.

The precision is obtained by means of circuitry which provides for a coarse adjustment and a subsequent fine adjustment for the locking of each output pulse 5*a* through 5*n* into synchronization with each other via an overtriggering voltage and a closed loop synchronization scheme.

A digital to analog converter 7 controls the total angular sweep scan which may typically be of the order of 140 degrees limited only by the effective individual radiating element characteristics. A potential range in excess of one mile on human targets and up to 100 miles when used as a line feed for a parabolic cylindrical reflector for ship formation station-keeping applications is indicated.

Figures 2, 2A:
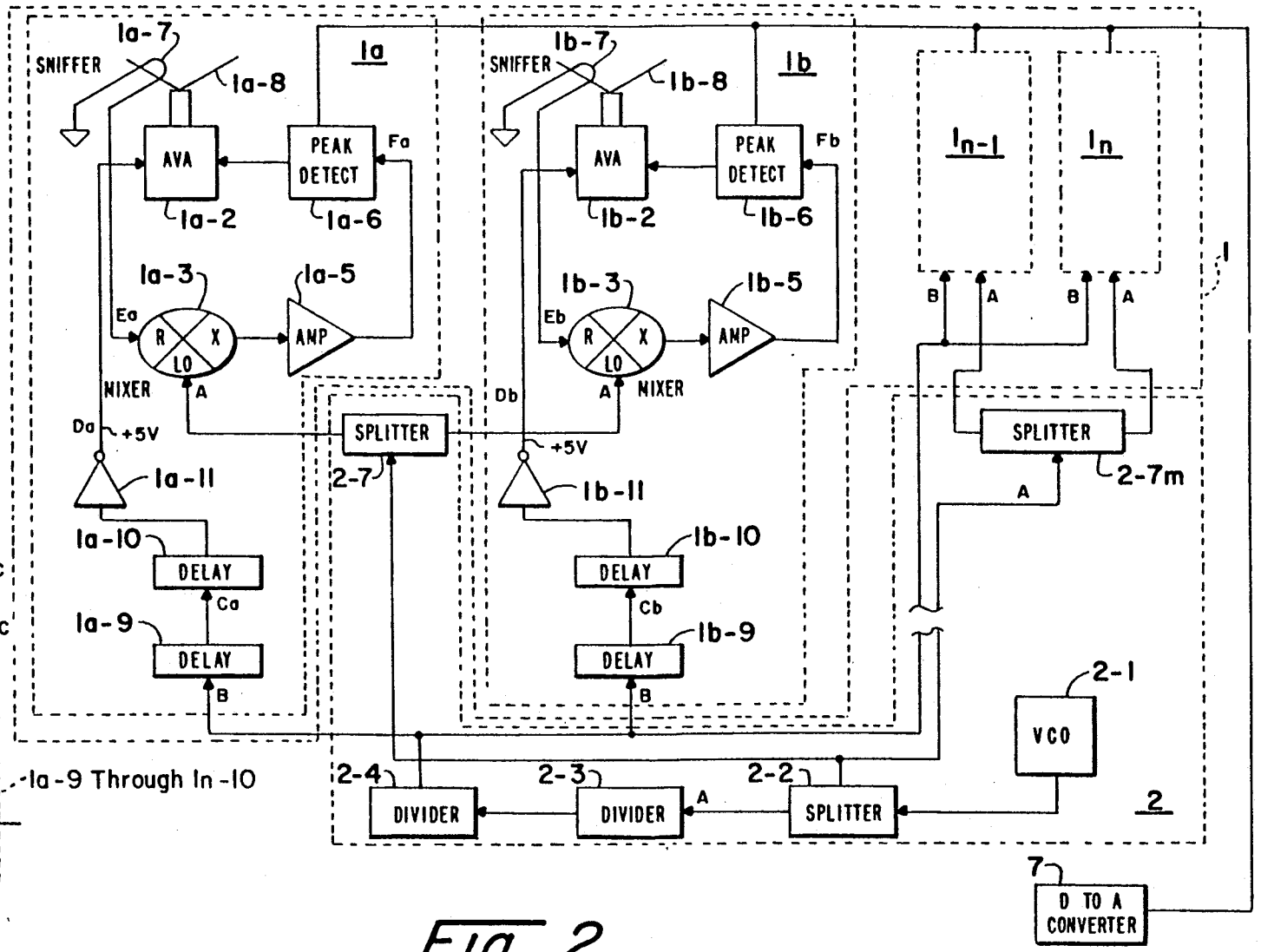
FIG. 2 is a block diagram showing the logic elements of the transmitter array system.
FIG. 2*a* shows the components connected to the delay logic elements.

FIG. 2 is a block diagram showing the logic elements of the array system 8 which includes transmitter array 1 and CW reference 2.

In order to simplify the technical explanation where applicable, only transmitter assembly 1*a* is described in detail, however it is understood by those of ordinary skill in the art that the solid state circuits of CW reference 2 control up to "n" transmitter asssemblies.

Assume that initially the output pulses 5*a* through 5*n* are not in synchronism. Therefore the narrow pulse width of output pulses 5 would have the shape of unsynchronized wave Gu of FIG. 4. Making a coarse adjustment and subsequent fine adjustment in each transmitter assembly 1*a* through 1*n* as shown by the delay timings "Ca through Cn" and "Da through Dn" of FIG. 4 result in synchronized wave "Gs". The fine adjustment is made by stretching and nulling the amplitude of each half wave pulse "Fa through Fn". The fine adjustment circuits will then continuously compensate for thermal drift.

Coarse Adjustment Logic

A continuous wave (CW) 1650 MHz signal from a Voltage Control Oscillator (VCO) 2-1 is fed through a splitter 2-2 to a two stage countdown chain which divides the input frequency by 8192 in a divider 2-3 and by 5 in a divider 2-4 to produce an approximately 40 KHz square wave synchronously related to the VCO 2-1 output signal. The 40 KHz square wave is applied to each delay 1*a*-9 through 1*n*-9 which operate as one-shot multivibrators. The output signal from each delay 1*a*-9 through 1*n*-9 is a single negative going square wave, each having a duration determined by the setting of their respective 2K ohm potentiometer 1*a*-9*p* through 1*n*-9*p*. The component connections are shown in FIG. 2*a*.

Delay 1*a*-10 is responsive to the rising edge of the output pulse from delay 1*a*-9 to generate a negative going pulse, the duration of which is set by a 2K ohm potentiometer 1*a*-10*p*. An invertor 1*a*-11 turns it into a positive going pulse. Delay 1*b*-10 through 1*n*-10 are each set individually by adjusting their respective potentiometer 1*b*-10*p* through 1*n*-10*p* to provide a coarse synchronization adjustment. Means for making these adjustments are well known by those of ordinary skill in the art.

The plus 5 volt output signals from each invertor 1*a*-11 through 1*n*-11 overdrive their respective avalanche transistor circuits 1*a*-2 through 1*n*-2 to reduce jitter. The pulse width of delays 1*a*-10*a* through 1*a*-10*n* are arbitrarily set to 100 ns. The timing and function of these output signals are described in relationship to the circuits of FIG. 3 and the timing diagram of FIG. 4.

Delays 1*a*-9 through 1*n*-10 are typically commercially available 74121 monostable multivibrators with Schmitt-trigger inputs. The 2K ohm resistors 1*a*-9*r* through 1*n*-10*r* between +5 volts and their respective potentiometer 1a-9p through 1n-10p provide for range control. The 56 pf capacitors 1a-9c through 1n-10c establish an external time constant.

Fine Adjustment Circuitry

Each solid state transmitter 1a through 1n of transmitter array 1 produces a pulse burst of several RF cycles centered at about 1500 MHz.

The generation of the RF pulse including its frequency and duration are a function of the physical properties of the antenna. This is described in the following United States Patents.

U.S. Pat. No. 3,545,002 entitled, "Wideband Wave Trapping Antenna Having a Time Limited Impulse Response" invented by Fenster.

U.S. Pat. No. 3,587,107 entitled, "Time Limited Impulse Response Antenna" invented by Ross.

U.S. Pat. No. 3,739,392 entitled, "Baseland Radiation and Reception System" invented by Ross and Robbins.

Each RF pulse burst is sampled by its respective "sniffer" 1a-7. Each "sniffer" 1a-7 through 1n-7 is mounted on, but electrically isolated from, its radiating structure 1a-8 through 1n-8.

The 1500 MHz signal from "sniffer" 1a-7 is fed to an RF (R) terminal of a mixer 1a-3 where it is mixed with the 1650 MHz signal from the VCO 2-1 through a splitter 2-2, a splitter 2-7 to a local oscillator (LO) terminal of mixer 1a-3. Each splitter 2-7 through 2-7m provides the 1650 MHz signal to a pair of transmitter assemblies 1a through 1n (m=n/2).

The down converted positive or negative half cycle output signal, centered at 150 MHz, from an IF (X) terminal of mixer 1a-3 is fed to a wideband IF amplifier 1a-5 (5–300 MHz at 20 dB gain). The input frequencies and duration of the pulse burst are selected to give a one half cycle output pulse. The half wave output pulse is positive or negative depending on the phase difference between the local oscillator and the several cycles within the transmitted pulse pachet. The output pulse has an amplitude at from 0 to plus or minus 550 millivolts (mv) and a pulse width of approximately 3 nanoseconds (ns). This is fed to a peak detector 1a-6. The stretched dual polarity output is amplified and fed as a bias to the avalanche transistor circuit 1a-2. This DC voltage appropriately applied as bias to the avalanche transistor causes the output pulse to be delayed or advanced in time. The time delay vs. time curve is shown in FIG. 5. The function performed by the output pulse is described in conjunction with FIGS. 3 and 4.

The mixer 1a-3 is typically a Mini-Circuits ZFM-15 solid state logic element, the splitters 2-2 and 2-7 are typically Mini-Circuits ZAPD-2 and ZFSC-2-11 solid state logic elements, the oscillator source 2-1 is a typically a Watkins Johnson V801 Voltage Control Oscillator and amplifier 1a-5 is typically a 20 dB Avantek wideband IF amplifier. These components are commercially available.

A Digital to Analog Converter 7 applies a sequence of stepped voltages to peak detector 1a-6 through 1n-6 in steps of from minus 5 to plus 5 volts to enable the transmitter array 1 to scan the target area repeatedly.

Figure 3:
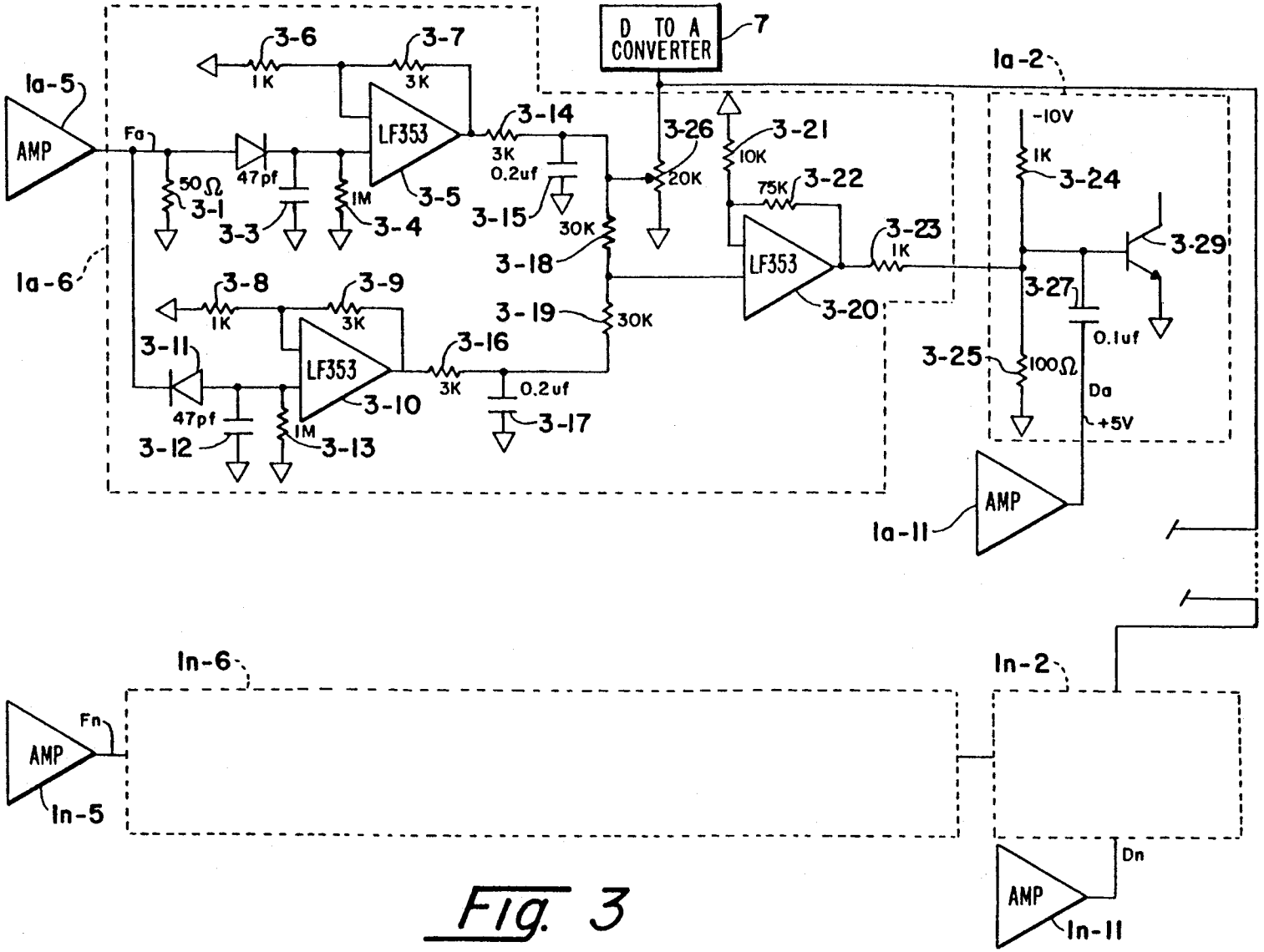
FIG. 3 is a circuit diagram showing the circuit components of a Dual Polarity Peak Detector.

FIG. 3 shows the circuitry of one of the peak detectors 1a-6 through 1n-6 and its respective avalanche transistor circuit 1a-2 through 1n-2. For simplicity, the circuit of transmitter 1a is described.

The output pulse from each amplifier 1a-5 through 1n-5 with a pulse amplitude of from 0 to plus or minus 550 mv and a pulse width of approximately 3 nanoseconds (ns) is fed a pair of hot carrier diodes (HCD) 3-2 and 3-11 of the respective peak detector 1a-6 through 1n-6. The amplitude is a measure of the phase difference between the transmitted 1500 MHz signal sampled by the "sniffer" 1a-7 and the 1650 MHz signal from the VCO 2-1. If the pulse is positive with an amplitude of greater than 150 mv then HCD 3-2 is forward biased. If the pulse is negative with an amplitude more negative than minus 150 mv then HCD 3-11 is forward biased. A 50 ohm resistor 3-1 provides the load for the IF amplifier 1a-5. The amplifier 1a-5 gain is adjustable to control the signal level HCD 3-2 and 3-11. The anomolous region due to the work potential region of the HCD diodes can be reduced significantly by the use of doped tunnel diodes or "back" diodes in place of the HCD diodes.

This will charge either 47 pf capacitors 3-3 or 3-12 with their respective loads, 1 meg resistors 3-4 or 3-13. This RC circuit holds the charge on an input terminal of amplifiers 3-5 or 3-10 during the pulse repetition period. Assume that a positive pulse is applied to an input terminal of amplifier 3-5. The amplifier 3-5 gain is 1 plus the ratio of the value of a 3K ohm resistor 3-7 divided by the value of a 1K ohm resistor 3-6 or a gain of 4. Amplifier 3-5 has an input impedance of 10 gigohm which is necessary in order not to load down capacitor 3-3 and resistor 3-4. Increasing amplifier gain and/or the use of back diodes further reduces the closed loop thermal drift; stability considerations determine the maximum loop gain.

A 3K ohm resistor 3-14 and a 0.2 uf capacitor 3-15 act as a low pass filter to smooth the DC output level from the amplifier 3-5. When there is a positive voltage at the output terminal of amplifier 3-5, then the output terminal of amplifier 3-10 is at a low impedance to ground. Therefore 30K ohm resistors 3-18 and 3-19 act as a voltage divider and is the load for both the positive and negative legs of the peak detector circuit.

The midpoint of the voltage divider is DC coupled to an amplifier 3-20 which acts as an isolation stage with a gain of 1 plus the ratio of the value of a 75K ohm resistor 3-22 divided by the value of a 10K ohm resistor 3-21 or a gain of 8.5. The output of amplifier 3-20 feeds the junction of a 1K ohm resistor 3-24 and a 100 ohm resistor 3-25 through a 1K ohm resistor 3-23 to bias the base of an RS3500 avalanche transistor 3-29. In addition, a 20K ohm potentiometer 3-26 allows for fine tuning of the bias voltage on the base of the avalanche transistor 3-26. It provides for a delay of up to 606 picoseconds, that is, one cycle of the VCO 2-1 (plus or minus 30 millivolts). This is the feedback DC voltage that delays or advances the transmitted pulse. This adjustment is set to null the amplitude of the half wave output pulse from amplifier 1a-5.

Amplifiers 3-5, 3-10 and 3-20 are commercially available LF353 FET operational amplifiers.

If a DC voltage is applied to the base of an avalanche transistor, then the time at which it avalanches is delayed by an amount proportional to the amplitude of this negative base voltage as shown in FIG. 5. The avalanche transistor may be prevented from firing if the base bias is more negative than minus 3 volts.

The coarse adjustment output signal at +5 volt from invertor 1a-11 is AC coupled to the base of the avalanche transistor 3-29 through a 0.1 uf capacitor 3-27. The avalanche transistor 3-29 starts the generation of the transmitted pulse on the rising edge of the coarse adjustment output signal from delay 1a-10 via invertor 1a-11. The frequency and duration of the transmitted pulse is determined by the transient characteristics or impluse response of the radiating structure 1a-8. The time between the start of successive bursts is determined by the rise of each cycle of the 40 KHz signal from the divider 2-4.

The eight bit digital to analog converter (DAC08) 7 which provides stepped voltages to potentiometer 3-26 in steps of from minus 5 to plus 5 volts enables each synchronized beam 5a through 5n forming narrow beam 5 to scan the target area in synchronism through typically 140 degrees. D to A converters are commercially available from such companies as Motorola and Analogic etc.

Once the transmitted bursts are in synchronization, any thermal drift in a component will change the phase relationship between the burst as detected by the respective "sniffer" 1a-7 through 1n-7 and the VCO 2-1 CW signal. This change is detected in the respective mixer 1a-3 through 1n-3 and the amplitude of the half cycle from the IF terminal becomes either positive or negative. This change converted to DC is reflected in the base circuit of the avalanche transistor 3-29 which either advances or delays the time of firing driving the output of amplifier 1a-5 to a null thereby compensating for any thermal drift.

Therefore once the coarse adjustments and subsequent fine adjustments are made by means of each potentiometer 3-26, all of the transmitters are locked into synchronization via a closed feedback loop.

Figure 4:
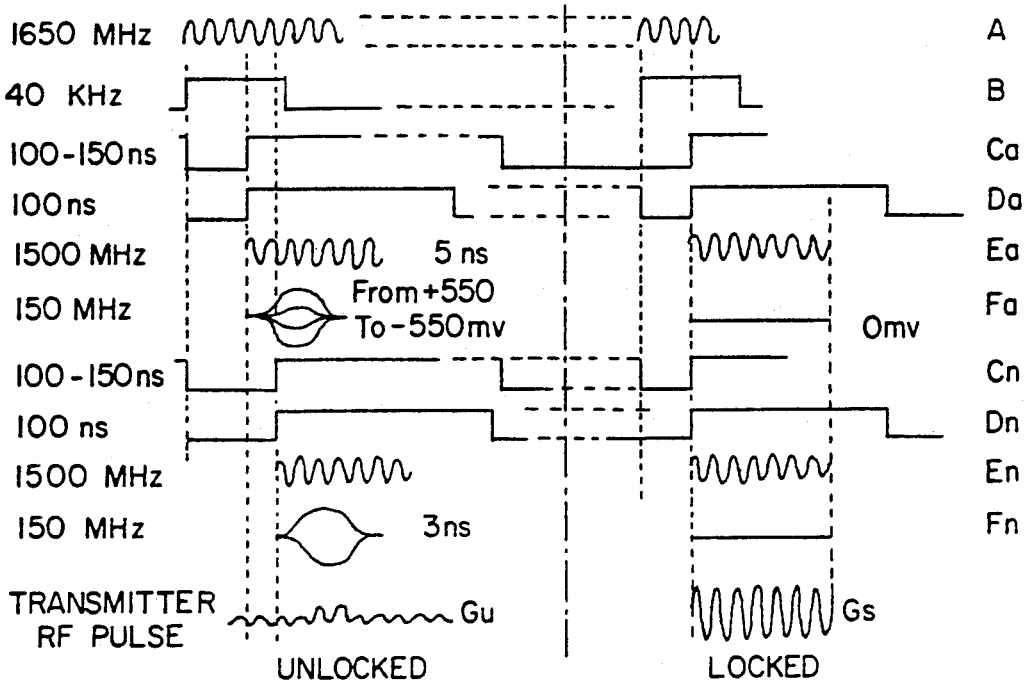
FIG. 4 is a timing diagram showing the circuitry for the coarse and fine synchronization adjustments.
Figure 5:
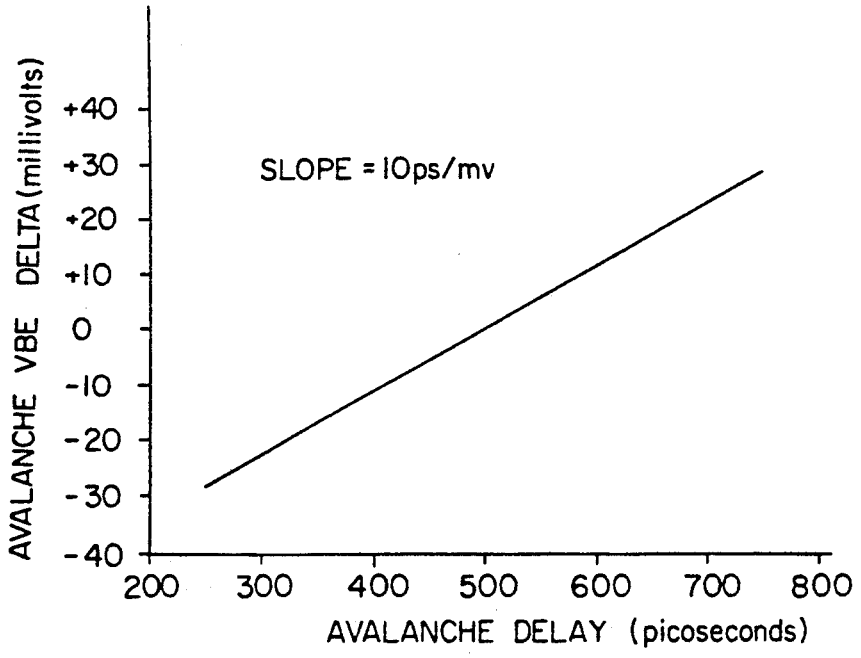
FIG. 5 shows the time delay vs. voltage relationship of the avalanche transistor circuit ("the timer").

FIG. 4 shows the timing chart showing how the individual bursts 5a through 5n are brought into coarse synchronization. The wave shapes are identified on FIGS. 2 and 3 as A, B, Ca through Cn, Da through Dn, Ea through En, Fa through Fn, Gu and Gs. The synchronization of only two transmitters 1a and 1n is shown, but it is obvious to one of ordinary skill in the art to synchronize "n" transmitters to each other.

The 1650 MHz CW "A" is fed to each divider chain. The 40 KHz output signal "B" from the divider chain 2-3 and 2-4 is fed to each delay 1a-9 through 1n-9 which are activated on the rise of each 40 KHz signal cycle. After adjustable delays, delays 1a-10 through 1n-10 are activated on the rise of signals "Ca through Cn" and their respective output signals inverted by invertors 1a-11 to generate signals "Da through Dn" which are in turn fed to fire their respective avalanche transistors.

The pulse bursts "Ea through En" of several cycles of 1500 MHz energy which are generated by the avalanche transistors are sensed by the "sniffers" and are fed to the mixers as is the 1650 MHz CW signal. The mixer compares the frequencies and outputs the half wave signals "Fa through Fn" to the peak detectors. The amplitudes will vary between plus and minus 550 mv depending on the degree of out of phase relationship. The bursts "Ea through En" are summed to generate a series of short duration pulses "Gu". However, since the bursts are not synchronized, the amplitude of Gu is small, there is dispersion and the beam is wide.

Adjusting the delays "Ca through Cn" results in delays "Da through Dn" being in synchronization. This results in bursts "Ea through En" being in synchronization. "Fa through Fn" are now at null. Short pulse "Gs" now has maximum amplitude and narrow beam width with resulting increased target range.

The power generating elements, for example, could be laser activated GaAs switches. The output of the avalanche transistor would now serve as the trigger source to the laser element. And the loop would be closed in the same fashion. The purpose of using the synchronization here would be as a convenient means of beam steering.

While the invention has been shown and described with reference to the preferred embodiment thereof, it will be understood by those skilled in the art that the above and other changes in form and detail may be made therein without departing from the spirit and scope of the invention.

We claim:

1. An array system for transmitting synchronized short pulse microwave signals for antenna beam narrowing and scanning a target area, said system comprising:

oscillator means for generating a reference CW signal at a first predetermined frequency and a clocking signal at a second predetermined frequency, said clocking signal being synchronously related to said CW signal;

converter means for generating a sequence of stepped voltages varying in increments between a first and a second voltage, a plurality of transmitters, each simultaneously receiving said CW signal and said clocking signal, each of said plurality of transmitters comprising:

delay means coupled to said oscillator means and responsive to each cycle of said clocking signal for generating a trigger pulse;

driving means coupled to said delay means and responsive to said trigger pulse for generating an RF signal at a third predetermined frequency and having a predetermined duration, said trigger pulse having a predetermined amplitude for overtriggering said driving means for reducing short term jitter;

said delay means having adjustment means for changing the timing relationship between said clocking signal and said trigger signal for said each of said plurality of transmitters for synchronizing each of said RF signals to each other sniffer means for sampling said RF signal and generating a sniffer RF signal;

mixer means coupled to said oscillator means and said sniffer means and responsive to said CW signal and said RF signal for generating a half cycle pulse having an amplitude indicative of the difference in phase relationship between said CW signal and said RF sniffer signal; and peak detector means, including fine tuning means for synchronizing said RF signal so that it coalesces at some angle in the far field with each of said RF signals, said peak detector means being coupled to said mixer means, and responsive to said half cycle pulse for generating a base feedback signal, said driving means being responsive to said base feedback signal to shift the timing of said RF signal linearly so that said half cycle pulse is at null thereby locking said each of said RF signals in synchronism with each other and compensating for thermal drift said peak detector means having said fine tuning means coupled to said converter means and responsive to said sequence of stepped voltages for having said each of said RF signals scan the target area in synchronism at predetermined angles.

2. The system of claim 1 wherein said oscillator means comprises:

a voltage control oscillator (VCO) means for generating said CW signal;

dividing means responsive to said CW signal for generating said clocking signal.

3. The system of claim 2 wherein said first predetermined frequency is at 1650 MHz and said second predetermined frequency is at 40 KHz.

4. The system of claim 3 wherein said delay means comprises:

first one-shot means responsive to each rising edge of said clocking signal for generating a first trigger signal after a first preset delay;

second one-shot means responsive to said first trigger signal for generating a second trigger signal after a second preset delay;

invertor means responsive said second trigger signal for generating said trigger signal.

5. The system of claim 4 wherein said adjustment means comprises:

first means for setting said first preset delay to time said trigger signal for synchronizing said each of said RF signals to each other;

second means for setting said second preset delay for determining the duration of said trigger pulse at typically 100 nanoseconds.

6. The system of claim 5 wherein said driving means comprises:

means for AC coupling said trigger signal to a base of an avalanche transistor means;

said avalanche transistor means for generating an output pulse in response to said trigger signal;

a radiating structure responsive to said output pulse for generating said RF signal.

7. The system of claim 6 wherein said third predetermined frequency is at 1500 MHz and said predetermined duration is typically several nanoseconds.

8. The system of claim 6 wherein said mixer means comprises:

a mixer for receiving said CW signal and said RF sniffer signal for generating a first pulse;

first amplifier means for receiving said first pulse for generating said half cycle pulse.

9. The system of claim 8 wherein said amplitude of said half cycle pulse is between +550 and −550 millivolts depending upon the phase relationship between said CW signal and said RF sniffer signal, and having a pulse duration of typically 3 nanoseconds.

10. The system of claim 9 wherein said peak detector means comprises:

dual polarity input means for amplifying said half cycle pulse, second amplifier means, including said fine tuning means for further amplifying said half cycle pulse for generating said base feedback signal.

11. The system of claim 10 wherein said predetermined angles are typically from 0 to 140 degrees.

12. An array system for transmitting synchronized short pulse microwave signals for antenna beam narrowing and scanning a target area, said system comprising:

oscillator means for generating a plurality of synchronized signals synchronously related to each other;

converter means for generating a sequence of stepped voltages varying in increments between a first and a second voltage, a plurality of transmitters, each simultaneously receiving said plurality of synchronized signals, said each having, trigger means responsive to a second synchronized signal of said plurality of synchronized signals for generating a sequence of overtrigger signals, pulse generating means responsive to each of said sequence of overtrigger signals for generating an output pulse having minimum jitter, radiating means responsive to said output pulse for generating an RF signal, closed loop feedback means responsive to a first synchronized signal of said plurality of synchronized signals and said RF signal for generating a base correction signal to compensate for thermal drift, said pulse generating means being responsive to said base correction signal for shifting the timing of said output pulse thereby keeping said RF signals from each of said plurality of transmitters in synchronization, said closed loop feedback means of said each of said plurality of transmitters further having fine tuning means responsive to said sequence of stepped voltages for scanning said target area in synchronism.

13. The system of claim 12 wherein said oscillator means comprises:

a voltage control oscillator means for generating said first synchronized signal as a reference continuous wave signal at a frequency of 1650 MHz, and a divider means responsive to said first synchronized signal for generating said second synchronized signal at a frequency of 40 KHz.

14. The system of claim 13 wherein said trigger means comprises:

first one-shot means responsive to each rising edge of said second synchronized signal for generating first trigger signals after a first preset delay;

second one-shot means responsive to said first trigger signals for generating second trigger signals after a second preset delay;

invertor means responsive said second trigger signals for generating said overtrigger signals.

15. The system of claim 14 wherein said first one-shot means comprises:

first means for setting said first preset delay to time said second trigger signals for synchronizing said each of said RF signals to each other.

16. The system of claim 15 wherein said second one-shot means comprises:

second means for setting said second preset delay for determining the duration of said overtrigger signals at typically 100 nanoseconds.

17. The system of claim 16 wherein said closed loop feedback means comprises:

mixer means for receiving said first synchronized signal and said RF signal for generating a first pulse;

first amplifier means for receiving said first pulse for generating a half cycle pulse, the amplitude of said half cycle pulse being between +550 mv and −550 mv depending upon the phase relationship between said first synchronized signal and said RF signal, and having a pulse duration of typically 3 nanoseconds, dual polarity input means for amplifying said half cycle pulse, second amplifier means, including said fine tuning means for further amplifying said half cycle pulse for generating said base feedback signal.

18. The system of claim 12 wherein said first and said second voltages are plus 5 volts and minus 5 volts respectively.

19. An array system for transmitting synchronized short pulse microwave signals or antenna beam narrowing and scanning a target area, said system comprising:

a plurality of transmitters, each having radiating means for generating a short RF signal;

reference means for generating a plurality of cyclic signals, each synchronously related to each other;

each of said transmitters including, synchronizing means responsive to a first of said cyclic signals for generating a timed overtrigger signal, said radiating means being responsive to said timed overtrigger signal for generating said short RF signal synchronously related to said RF signal from said each transmitter, and feedback locking means having temperature compensation means responsive to a second of said cyclic signals and said RF signal for generating a fine tuning synchronization signal, said radiating means being responsive to said synchronization signal for shifting the timing of said short RF signal to retain synchronism with said each RF signal.

20. An array system for transmitting synchronized short pulse microwave signals for antenna beam narrowing and scanning a target area, said system comprising:

a plurality of transmitters, each having radiating means for generating a short RF signal;

reference means for generating a plurality of cyclic signals, each synchronously related to each other;

each of said transmitters including, synchronizing means responsive to a first of said cyclic signals for generating a timed overtrigger signal, said radiating means being responsive to said timed overtrigger signal for generating said short RF signal synchronously related to said RF signal from said each transmitter, and feedback locking means having fine tuning means responsive to a second of said cyclic signals and said RF signal for generating a fine tuning synchronization signal, said radiating means being responsive to said synchronization signal for shifting the timing of said short RF signal to coalesce in the far field.

* * * * *